US005565644A

United States Patent [19]

Chawla

[11] Patent Number: 5,565,644

[45] Date of Patent: Oct. 15, 1996

[54] SHAPED CHARGE WITH WAVE SHAPING LENS

[75] Inventor: Manmohan S. Chawla, Houston, Tex.

[73] Assignee: Western Atlas International, Inc., Houston, Tex.

[21] Appl. No.: 508,335

[22] Filed: Jul. 27, 1995

[51] Int. Cl.[6] ..... F42B 1/02; F42B 12/10

[52] U.S. Cl. ..... 102/307; 102/476; 102/701; 175/4.6

[58] Field of Search ..... 102/306–310, 102/476, 701; 175/4.6

[56] References Cited

U.S. PATENT DOCUMENTS

| | | | |
|---|---|---|---|
| 3,027,838 | 4/1962 | Meddick | 102/309 |
| 3,034,393 | 5/1962 | Lieberman et al. | 102/309 |
| 3,100,445 | 8/1963 | Poulter | 102/309 |
| 3,147,707 | 8/1964 | Caldwell | 102/309 |
| 4,111,126 | 9/1978 | Thomanek | 102/476 |
| 4,594,947 | 6/1986 | Aubry et al. | 102/309 |
| 4,729,318 | 3/1988 | Marsh | 102/308 |
| 5,322,020 | 6/1994 | Bernard et al. | 102/476 |

FOREIGN PATENT DOCUMENTS

| | | | |
|---|---|---|---|
| 1531538 | 7/1968 | France | 102/476 |
| 2634876 | 2/1990 | France | 102/307 |
| 2246621 | 2/1992 | United Kingdom | 102/476 |

*Primary Examiner*—Harold J. Tudor
*Attorney, Agent, or Firm*—Alan J. Atkinson

[57] ABSTRACT

An improved shaped charge for generating a jet. A lens shaped waveshaper is positioned within the explosive material of a shaped charge to modify the shape of the divergent detonation wave into a planar wave or a converging wave. The waveshaper is formed with a low sound speed material having a high index of refraction. By reshaping the detonation wave, the acceleration of the shaped charge liner is increased, and the penetration depth and hole size of the jet can be increased. The shaped charge operates more efficiently, thereby requiring less explosive material than a conventional shaped charge.

7 Claims, 1 Drawing Sheet

SHAPED CHARGE WITH WAVE SHAPING LENS

BACKGROUND OF THE INVENTION

The present invention relates to shaped charges for generating a metallic jet. More particularly, the present invention relates to an improved shaped charge that incorporates a lens shaped waveshaper to modify an explosive wave impacting the liner in a shaped charge.

Shaped charges are used in the oil and gas industry and in other fields to pierce metal, concrete, and other solid materials. In an oil or gas well, a metallic casing is cemented to the borehole walls to maintain the borehole integrity. Shaped charges are incorporated in a hollow carrier gun or a strip positioned in the casing. The shaped charges are activated to pierce the well casing and the geologic formation at the hydrocarbon producing zone. The hydrocarbons enter the casing through such perforations and are transmitted to the well surface.

Conventional shaped charges are constructed with a charge case, a hollow conical liner within the case, and a high explosive material positioned between the liner and case. A detonator is activated to initiate the explosive material to generate a detonation wave. This wave collapses the liner and a high velocity metallic jet is formed. The jet pierces the well casing and geologic formation, and a slow moving slug is simultaneously formed. The jet properties depend on the charge shape, the energy released, and the liner mass and composition.

The penetrating power of the jet is determined by the jet velocity and other factors. One factor affecting jet velocity is the transfer of kinetic energy between the detonation wave and the liner. This transfer depends on the energy imparted by the detonation wave, the propogation of the detonation wave as a function of time, and the liner shape.

Waveshapers have been incorporated in shaped charges to delay a portion of the detonation wave, and to redirect the propogation of the detonation wave. Conventional waveshapers typically convert the point initiated detonation front to a peripherally initiated detonation within the shaped charge. Such waveshapers are typically constructed with wood, Teflon, plastic or other nonmetallic materials and redirect the detonation waves by partially inhibiting the transport of the detonation waves through the nonmetallic material.

Although conventional waveshapers are useful in shaping the detonation wave from a purely divergent wavefront, such waveshapers do not efficiently focus the energy of the detonation wave into contact with the shaped charge liner. Accordingly, a need exists for an improved shaped charge that efficiently focus the detonation waves.

SUMMARY OF THE INVENTION

The present invention provides a shaped charge responsive to a detonator for initiating a material penetrating jet. An explosive material can be initiated by the detonator to create a diverging detonation wave. A shaped liner having a hollow space is proximate to the explosive material and is collapsable when impacted by the detonation wave to form the material penetrating jet. A lens is positioned to shape the diverging detonation wave before such wave contacts the liner.

In other embodiments of the invention, a case can be positioned around the explosive material. The case can have an elliptical inner wall in contact with the explosive material. The lens can shape the diverging detonation wave to form a planar wave or a converging wave, and the focal point of the lens can be selected to focus the detonation wave on a particular point relative to said liner

DESCIPTION OF THE PREFERRED EMBODIMENTS

The present invention improves the efficiency of a shaped charge by focusing the divergent detonation wave produced by an explosive material.

Figure 1:
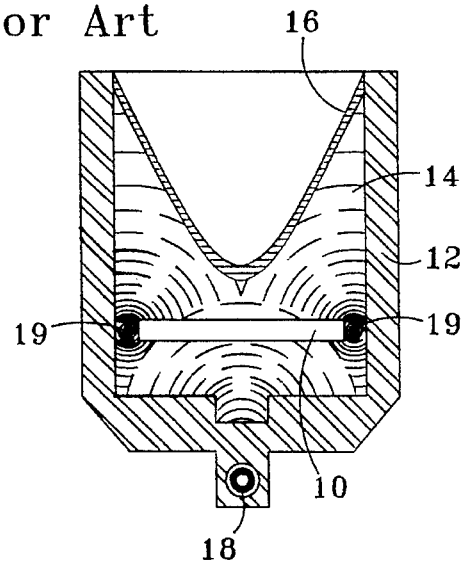
Fig. 1 Prior Art
FIG. 1 illustrates a prior art waveshaper within a shaped charge, and the patterns generated by a detonation wave.

FIG. 1 illustrates conventional waveshaper 10 positioned within case 12. Explosive material 14 is positioned within case 12, and is initially retained with liner 16. Explosive material is preferably positioned about an axis within case 12 which promotes the even distribution of the detonation wave through liner. Conventional waveshaper 10 is typically constructed with wood, Teflon, plastic or a similarly low density material.

When explosive material 14 is activated with detonator 18, chemical energy is converted to kinetic energy. Waveshaper 10 partially blocks the detonation wave diverging from detonator 18, and delays the propogation of the detonation wave through waveshaper 10. If the space between case 12 and the ends of waveshaper 10 is small, the detonation wave propagates around waveshaper 10 and creates peripheral initiation points 19 at each end of waveshaper 10. The wavefronts generated by peripheral initiation points 19 move along the inner wall of case 12 and diverge inwardly toward liner 16. In this fashion, the propagation of the detonation waves is directed by the inner wall of case 12, and the power of the detonation waves is concentrated accordingly. It will be appreciated that interference between the detonation waves within case 12 will cause uneven distribution of such waves across liner 16, and that the detonation waves will further diverge as such waves exit case 12.

Liner 16 can be constructed from a variety of materials and geometrical shapes. Liner materials include copper, aluminum. depleted uranium, tungsten, tantalum, and other materials. Representative examples of liner shapes include hemispheres, paraboloids, ellipsoids, pear shapes, and trumpet shapes. A case is not essential to the, performance of shaped charges, as a shaped charge can be constructed from the simple combination of a hollowed high explosive and a liner for lining the explosive cavity.

The collapse of liner 16 induced by the detonation wave creates a metallic jet and a slug traveling substantially parallel to the axis of explosive material 14. In an oil or gas well, the jet typically travels through a port plug and drilling mud before the jet impacts the well casing (not shown). The metallic jet travels at high velocities up to 10,000 meters per second, and creates a large pressure differential for piercing the target. Conventional waveshapers such as waveshaper 10 slightly change the impact angle of the detonation wave acting on liner 16, and results in a relatively small increase in gas jet velocity.

Figure 2:
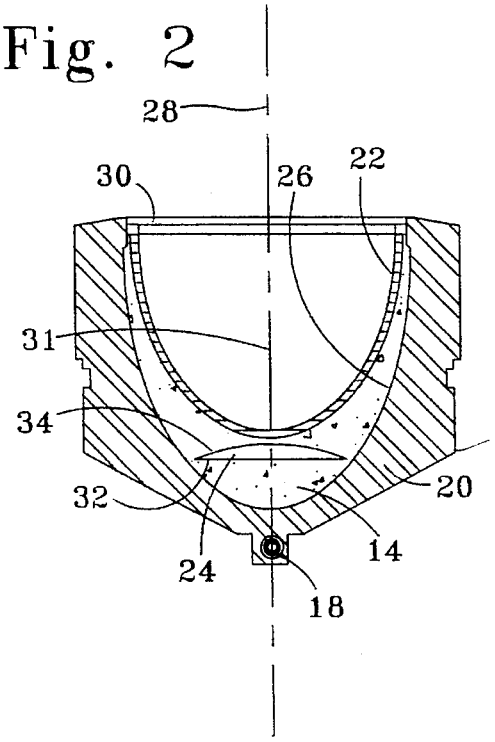
FIG. 2 illustrates an embodiment of the present invention having a lens waveshaper.

In contrast, the invention significantly alters the detonation wave. FIG. 2 illustrates one embodiment of the invention wherein case 20 holds explosive material 14, liner 22, and waveshaper 24. Case 20 is shown as a having an elliptical inner wall 26 which is substantially symmetrical about longitudinal axis 28. In one embodiment of the invention, inner wall 26 is shaped as an ellipsoid of revolution about longitudinal axis 28, and does not have any indentions or protrusions in inner wall 26.

Detonator 18 is positioned at the closed end of case 20, and liner 22 is preferably engaged with inner wall 26 with a fastening device such as ring 30. A portion of shaped charge liner 22 is focused on point 31 on longitudinal axis 28. The resulting convergence imparts a significantly greater velocity to the imploded portion of liner 22. In various tests, performance gains of fifteen percent in higher jet velocity have been realized.

Waveshaper 24 is shaped as a lens having substantially flat surface 32 and convex surface 34. In various embodiments of the invention, waveshaper 24 can be shaped as a plano-convex or convex-convex lens sufficient to create convergence of the detonation wave. In other embodiments of the invention, waveshaper 24 can shape the divergent detonation wave into a planar waveform or other shape. Waveshaper 24 is preferably formed with a low sound speed material such as lead, or depleted uranium. These materials have sound velocities that are approximately one quarter of the typical detonation speed for conventional high explosive material, which creates a high value refractive index for the operation of lens shaped waveshaper 24.

Figure 3:
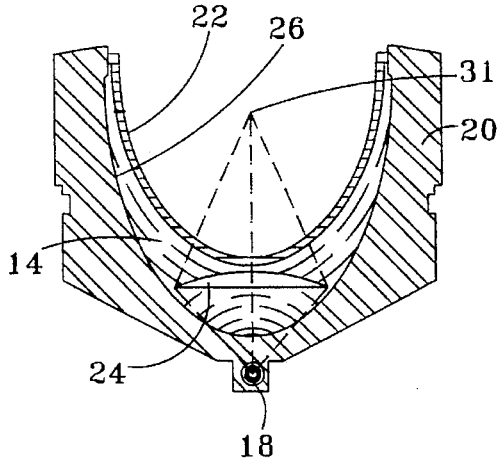
FIG. 3 illustrates the operation of the present invention showing one form of wave shape created by a lens

As shown in FIG. 3, waveshaper 24 operates to focus the detonation wave resulting from the detonation of explosive material 14. Waveshaper 24 focuses such detonation wave and converts the spherically divergent wave to the waveform illustrated or to a desired waveform such as a spherically convergent wave or a planar waveform. In this fashion, waveshaper 24 can conform the detonation wave to impact substantially all of liner 22 surface at the same time. This effect increases the overall jet velocity by increasing the energy coupled between the detonation wave and liner 22. Instead of redirecting the detonation waves as performed by waveshaper 10 in FIG. 1, the present invention refocuses the detonation waves to a specific focal point.

The waveshaping function performed by the,present invention can be described by Snell's Law of optics, which relates the lens geometry, lens focal length, object distance, image distance, and the lens index of refraction. If the shock wave performance is modeled after the field of optics, the "lens index of refraction" is defined as the ratio of detonation velocity and the material shock (sound) velocity. If a low sound speed material such as lead or depleted uranium is used for the waveshaper 24, the refractive index is maintained at a high level (by reducing the denominator of the lens index of refraction) and the thickness of waveshaper 24 can be minimized accordingly. As the size of waveshaper 24 is minimized, less explosive material 14 is replaced by inert material.

Figure 4:
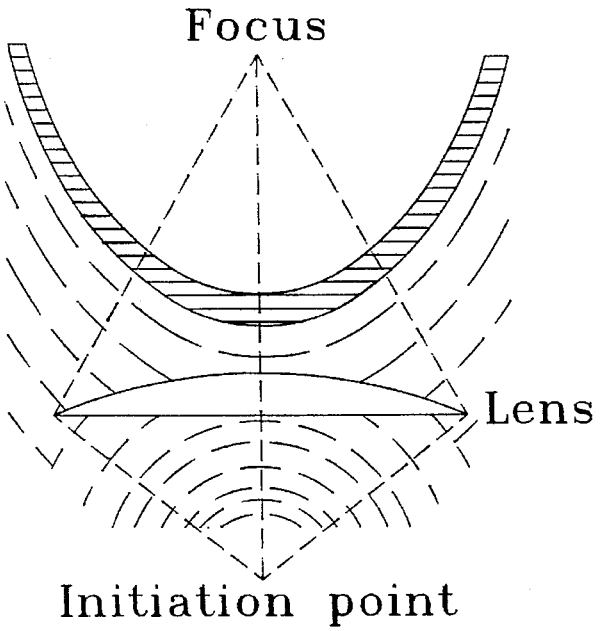
FIG. 4 illustrates a schematic view of a lens relative to explosive material and a liner.

FIG. 4 graphically depicts the operation of waveshaper 24 to convergently shape the detonation wave. The "lensmaker" equation is wellknown, and is expressed by:

$$1/u+1/v=1/f$$

$$(\mu-1)(1/r_1+1/r_2)=1/f$$

and $$\mu=v_D/v_s$$

where u=the distance between lens and initiation point v=the distance between lens and imploded liner convergence point f=lens focal length $r_1$=radius of lens back surface (infinity if the back surface is flat)

$r_2$=radius of the lens front surface $\mu$=lens refractive index $v_D$=detonation velocity of explosive $v_s$=shock velocity of material at detonation pressure From the known dimensions of refractive index $\mu$, lens distance from the liner center of curvature (or v) and the lens distance from the initiation point (or u), the lens radius ($r_2$) can be determined for a plano-convex lens. The diameter of the lens is equal to the case opening at the lens placement, less sufficient clearance to maintain a critical diameter of explosive material 14 on all sides of waveshaper 24.

The present invention provides several significant advantages over conventional waveshapers. The velocity of the jet is increased, the slug residue is decreased, and a larger hole with deeper penetration can be accomplished with shaped charges utilizing the present invention.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A shaped charge responsive to a detonator for initiating a material penetrating jet, comprising:

an explosive material formed about an axis and activatable by the detonator to create a diverging detonation wave;

a shaped liner having a curved surface, in an axial cross-section, proximate to said explosive material, wherein said liner defines a hollow space, and wherein said liner is collapsable about said hollow space to form the material penetrating jet; and a solid lens proximate to said explosive material for shaping said diverging detonation wave before said detonation wave contacts said liner, said solid lens means shapes said diverging detonation wave to form an inwardly converging wave toward said axis, said converging wave having a curvature substantially equal to the curved surface of said liner so that the converging wave impacts substantially all of the curved surface at the same time, wherein said solid lens means comprises a low sound speed metallic material having a sound speed that is approximately one quarter of the detonation speed of said explosive material.

2. A shaped charge as recited in claim 1, further comprising a case for initially containing said explosive material.

3. A shaped charge as recited in claim 2, wherein the inner surface of said case in contact with said explosive material is curved to provide a substantially unbroken surface which is symmetrical about the axis of said explosive material.

4. A shaped charge as recited in claim 3, wherein the inner surface of said case is substantially shaped as an ellipsoid.

5. A shaped charge as recited in claim 1, wherein said, solid lens means has a substantially flat surface proximate to the detonator, and wherein said solid lens means further has a convex surface opposite said flat surface.

6. A shaped charge as recited in claim 1, wherein said liner has an elliptical shape which is symmetrical about the axis of said explosive material, and wherein said liner has an apex.

7. A shaped charge as recited in claim 1, wherein said solid lens means converges said detonation wave to focus on a center of said liner.

* * * * *